US007245263B2

(12) United States Patent
Hoshi

(10) Patent No.: US 7,245,263 B2
(45) Date of Patent: Jul. 17, 2007

(54) ANTENNA

(75) Inventor: Fumikazu Hoshi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/354,708

(22) Filed: Feb. 15, 2006

(65) Prior Publication Data

US 2006/0187134 A1 Aug. 24, 2006

(30) Foreign Application Priority Data

Feb. 18, 2005 (JP) ..... 2005-042743

(51) Int. Cl.
*H01Q 13/00* (2006.01)
*H01Q 9/38* (2006.01)

(52) U.S. Cl. ..... 343/772; 343/830

(58) Field of Classification Search ..... 343/772, 343/773, 791, 830, 908
See application file for complete search history.

(56) References Cited

U.S. PATENT DOCUMENTS 6,284,971 B1 * 9/2001 Atalar et al. ..... 174/36
6,972,726 B2 * 12/2005 Sato et al. ..... 343/725
7,006,047 B2 * 2/2006 Marsan et al. ..... 343/705
7,027,004 B2 * 4/2006 Haunberger et al. ..... 343/790

FOREIGN PATENT DOCUMENTS

JP 9-83238 3/1997
JP 9-153727 6/1997

* cited by examiner

*Primary Examiner*—Shih-Chao Chen
(74) *Attorney, Agent, or Firm*—Cooper & Dunham LLP

(57) ABSTRACT

An antenna supplied with power by a coaxial line including an inner conductor, an outer conductor, and a dielectric provided between the inner conductor and the outer conductor is disclosed. The antenna includes an antenna part including a first conductor and a second conductor, the second conductor including a conical shape having an apex thereof opposing the first conductor; and a transition area having an effective dielectric constant different from the dielectric constant of the dielectric in the coaxial line, the transition area being provided in the end part of the coaxial line connected to the antenna.

17 Claims, 18 Drawing Sheets

ANTENNA

BACKGROUND OF THE INVENTION

1. Field of the Invention

The present invention relates generally to antennas, and more particularly to an antenna omnidirectional in a horizontal plane usable for mobile communications equipment, small-size information terminals, and other radio equipment.

2. Description of the Related Art

Monopole antennas and discone antennas are known as antennas that are omnidirectional in a horizontal plane (hereinafter also referred to as "horizontal-plane omnidirectional antennas") formed of a conductive base plate and a radiating element.

FIG. 1 is a side view of a conventional monopole antenna 100. Referring to FIG. 1, a coaxial connector 120 is attached to a disk conductor 110 from its lower side so that a center conductor 130 of the coaxial connector 120 extends upward, being isolated from the disk conductor 110. The length h of the radiating element of the monopole antenna 100 is required to be approximately a quarter of the wavelength of an electromagnetic wave of the lowest resonance frequency. At this point, the detailed size of the radiating element is determined depending on the impedance characteristics.

FIG. 2 is a side view of a conventional discone antenna 200. The discone antenna 200 is structured by shaping the center conductor 130 of the monopole antenna 100 like a cone. This shape may also be considered as the one formed by shaping one of the conical conductors of a biconical antenna like a disk. The discone antenna 200 has a conical conductor 210, whose diameter is indicated by d in FIG. 2.

An ideal discone antenna is infinite in size, and is not frequency-dependent. However, in a discone antenna having finite size, the upper limit of its operating wavelength is restricted to approximately four times the length h of the radiating element.

A case where the bandwidth is increased and a case where lower frequencies are covered in the horizontal-plane omnidirectional antenna formed of a conductive base plate and a radiating element as described above are shown below.

FIGS. 3A and 3B are a perspective view and a side view, respectively, of a first conventional antenna 300. As shown in FIGS. 3A and 3B, the antenna 300 includes a skirt part 310 and a top load part 320. The skirt part 310 includes a conical base body 311 and a spiral conductive element 312 formed along the exterior surface of the conical base body 311. The top load part 320 includes a flat base body 321 disposed in the vicinity of the apex part of the skirt part 310 and a meandering conductive element 322 formed on the surface of the flat base body 321.

In this antenna 300, the bandwidth is increased because the meandering conductive element 322 formed on the flat base body 321 has a relatively broad belt-like form and because multiple meandering lines make it possible to achieve multiple resonance. Further, the spiral conductive element 312 formed on the skirt part 310 make it possible to achieve electrical length longer than it appears. Accordingly, the antenna 300 can be reduced in size compared with the conventional discone antenna 200 (see Japanese Laid-Open Patent Application No. 9-083238).

FIGS. 4A and 4B are a side view and a plan view, respectively, of a second conventional antenna 400. As shown in FIGS. 4A and 4B, the antenna 400 includes a conductor 410 having an outer shape like a semioval body of revolution and a flat base plate 420. In the antenna 400, the bandwidth is increased and the size is reduced by shaping the radiating element like a semioval body of revolution or a hemisphere (see Japanese Laid-Open Patent Application No. 9-153727).

However, according to the first conventional antenna 300 (FIGS. 3A and 3B), it is necessary to form a meandering or spiral conductor pattern on the base body 321, and the conductor pattern density should be increased with an increase in the bandwidth, thus resulting in a complicated structure.

On the other hand, according to the second conventional antenna 400 using the flat base plate 420 (FIGS. 4A and 4B), a frequency band in which the antenna 400 is usable is subject to the dimensional elements of the radiating element. Accordingly, the antenna 400 should be increased in size in order to make it usable at lower frequencies.

SUMMARY OF THE INVENTION

Accordingly, it is a general object of the present invention to provide an antenna in which the above-described disadvantages are eliminated.

A more specific object of the present invention is to provide a small-size, light-weight antenna capable of broadband transmission and reception and usable in a lower frequency band.

The above objects of the present invention are achieved by an antenna supplied with power by a coaxial line including an inner conductor, an outer conductor, and a dielectric provided between the inner conductor and the outer conductor, the antenna including: an antenna part including a first conductor and a second conductor, the second conductor including a conical shape having an apex thereof opposing the first conductor; and a transition area having an effective dielectric constant different from a dielectric constant of the dielectric in the coaxial line, the transition area being provided in an end part of the coaxial line connected to the antenna.

According to one embodiment of the present invention, by providing a transition area having an effective dielectric constant different from that of the dielectric of a coaxial line in the end part of the coaxial line connected to an antenna, it is possible to control reflection due to the mismatch of the input impedance of an antenna part and the characteristic impedance of the coaxial line. Accordingly, it is possible to make a discone antenna usable in a lower frequency band and to increase its bandwidth without complicating the structure of the discone antenna.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

First Embodiment

Figure 5:
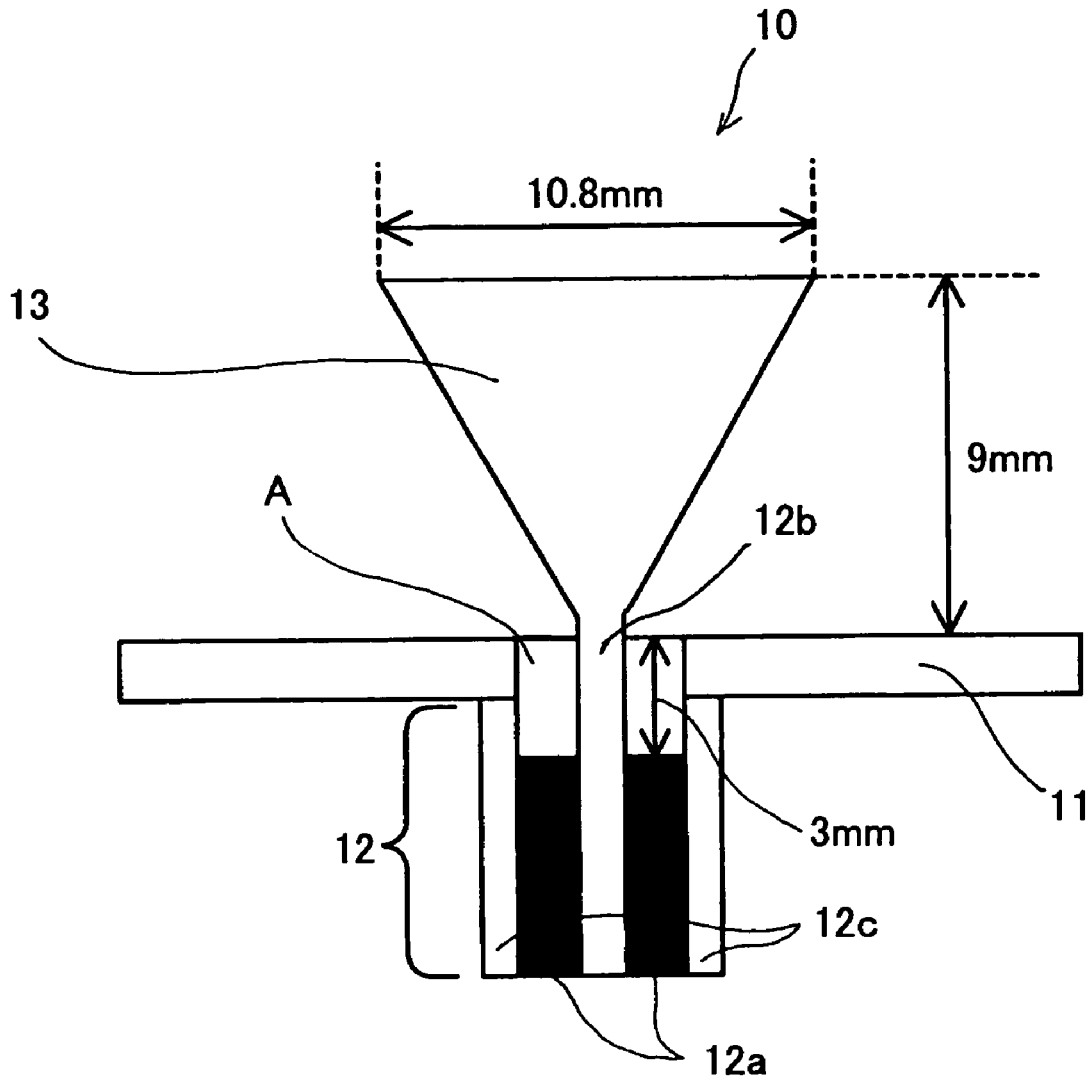
FIG. 5 is a cross-sectional view of an antenna according to a first embodiment of the present invention.

FIG. 5 is a cross-sectional view of a first antenna 10 according to a first embodiment of the present invention.

The first antenna 10 includes a disk conductor (conductive base plate) 11 serving as a base conductor and a first conical conductor 13. A coaxial line 12 is attached to the disk conductor 11 from its lower side. The inside of the coaxial line 12 is filled with polyethylene 12*a* of a dielectric constant of 2.3 serving as a dielectric. A center conductor 12*b* of the coaxial line 12 extends upward, being isolated from the disk conductor 11, so as to be connected to the first conical conductor 13. The coaxial line 12 further includes an outer conductor 12*c*. The disk conductor 11 may be shaped like a flat disk.

In a connection end part A where the coaxial line 12 and the first antenna 10 are connected, the polyethylene 12*a* inside the coaxial line 12 is removed by a length of 3 mm in the axial directions of the coaxial line 12. The bottom surface (facing upward in FIG. 5) of the first conical conductor 13 is 10.8 mm in diameter, and the first conical conductor 13 is 9 mm in height. The disk conductor 11 and the first conical conductor 13 are formed using copper as a principal material.

Figure 6:
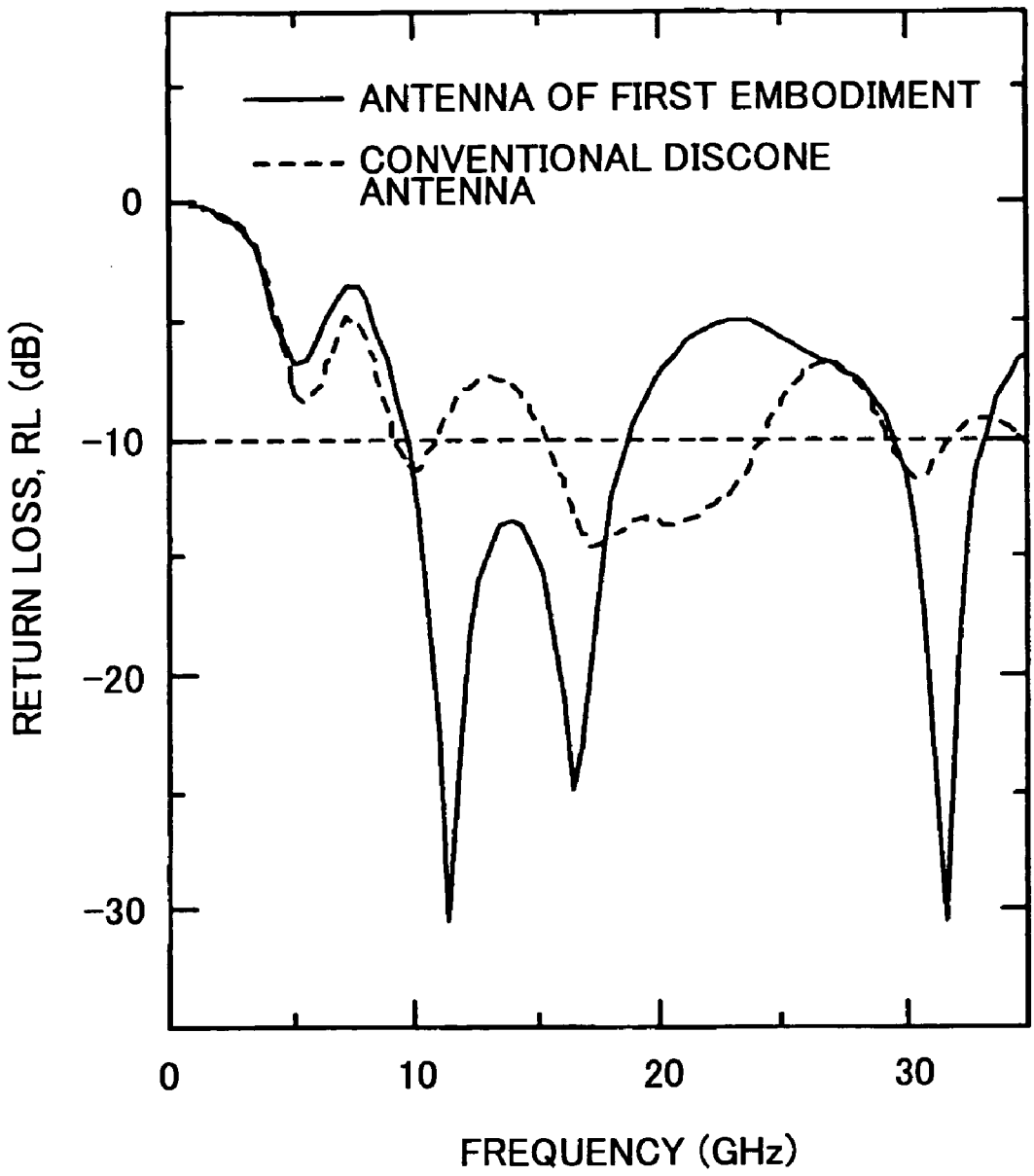
FIG. 6 is a graph showing the return loss-frequency characteristic of the antenna according to the first embodiment of the present invention.

A description is given of an operation of the first antenna 10 having the above-described configuration. FIG. 6 is a graph showing the return loss-frequency characteristic of the first antenna 10 of this embodiment. For comparison, the return loss-frequency characteristic of the conventional discone antenna 200 (FIG. 2) of the same height and vertex angle of the conical conductor as the first antenna 10 of this embodiment is also indicated by the broken line in FIG. 6.

In the case of the conventional discone antenna 200, the return loss is less than or equal to −10 dB in a frequency band of 15.40-24.22 GHz with a frequency bandwidth of 8.82 GHz. On the other hand, according to the first antenna 10 of this embodiment, the return loss is less than or equal to −10 dB in a frequency band of 9.66-18.80 GHz with a frequency bandwidth of 9.14 GHz. Thus, compared with the conventional discone antenna 200, the first antenna 10 of this embodiment covers low frequencies, and its bandwidth is increased.

Thus, according to the first embodiment of the present invention, it is possible to make a discone antenna usable in a lower frequency band and to increase its bandwidth without complicating the structure of the discone antenna.

Second Embodiment

Figure 7:
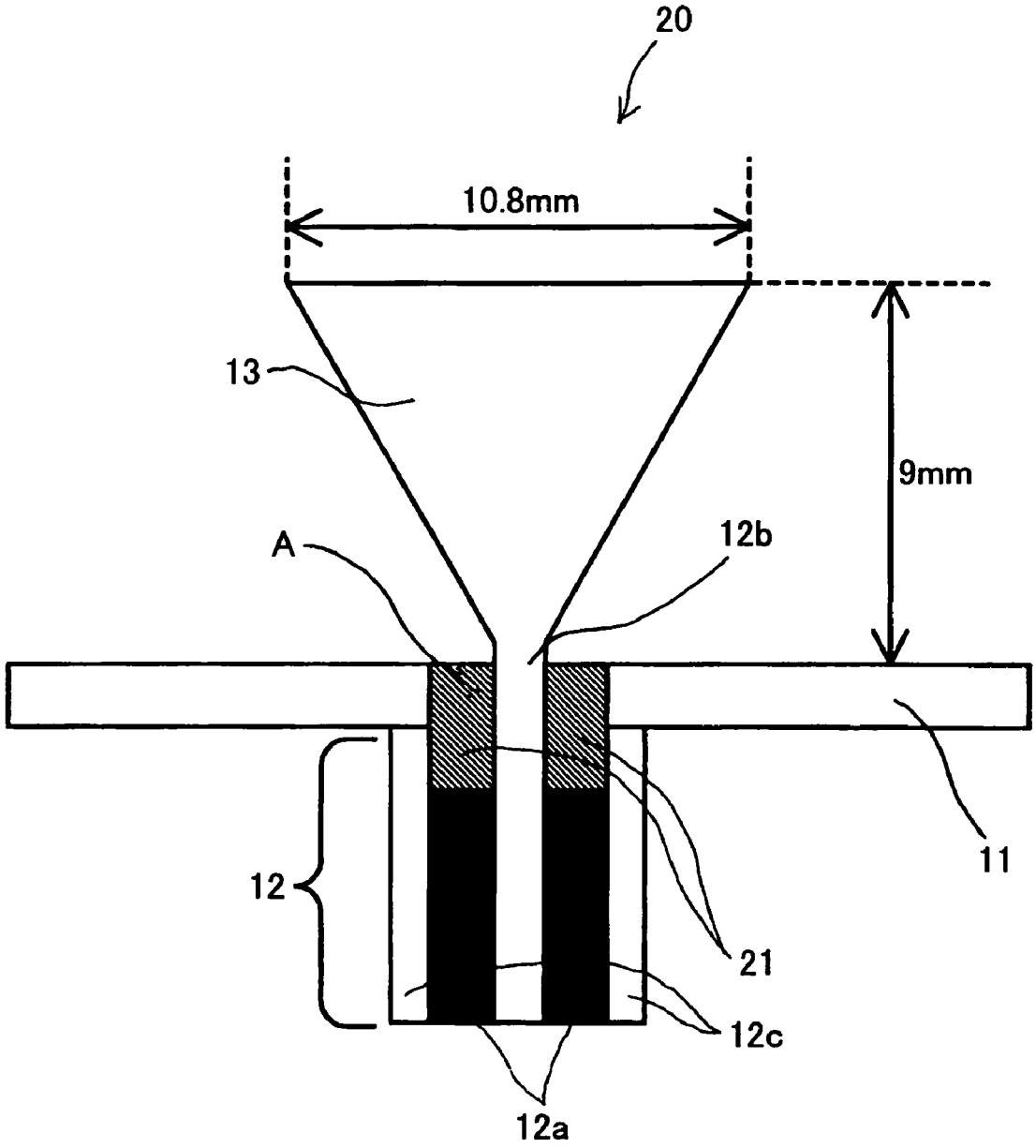
FIG. 7 is a cross-sectional view of an antenna according to a second embodiment of the present invention.

FIG. 7 is a cross-sectional view of a second antenna 20 according to a second embodiment of the present invention. In FIG. 7, the same elements as those described above are referred to by the same numerals, and a description thereof is omitted.

The second antenna 20 includes the disk conductor 11 and the first conical conductor 13. The coaxial line 12 is attached to the disk conductor 11 from its lower side. The inside of the coaxial line 12 is filled with the polyethylene 12*a* of a dielectric constant of 2.3. The center conductor 12*b* of the coaxial line 12 extends upward, being isolated from the disk conductor 11, so as to be connected to the first conical conductor 13. The coaxial line 12 further includes the outer conductor 12*c*.

In the connection end part A of the coaxial line 12 and the second antenna 20, the inside of the coaxial line 12 is filled with polyethylene foam 21 of a dielectric constant of 1.5 serving as an expandable dielectric material, so that a dielectric constant transition area is formed. The transition area is 3 mm in length in the axial directions of the coaxial line 12. The bottom surface (facing upward in FIG. 7) of the first conical conductor 13 is 10.8 mm in diameter, and the first conical conductor 13 is 9 mm in height. The disk conductor 11 and the first conical conductor 13 are formed using copper as a principal material.

Figure 8:
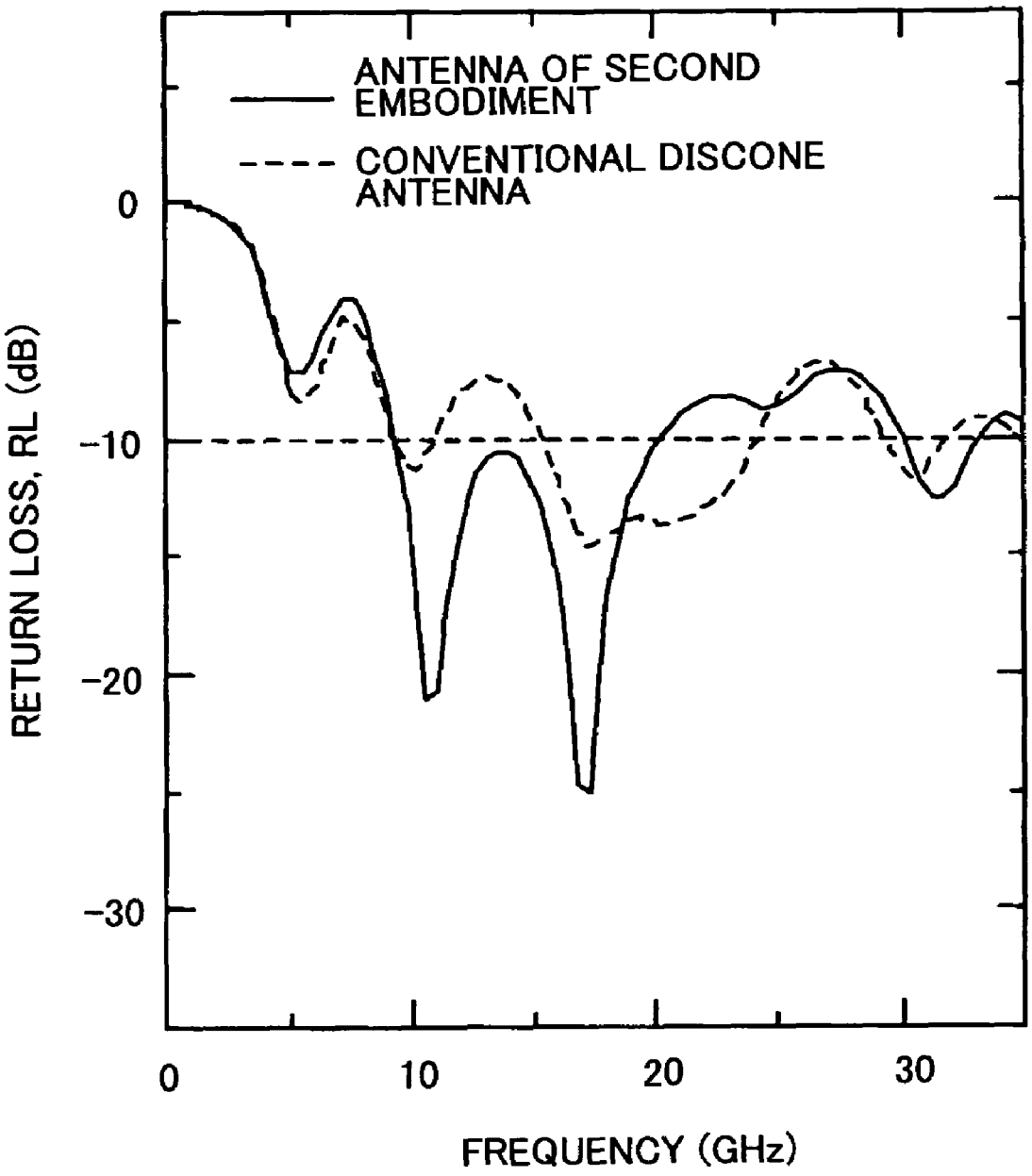
FIG. 8 is a graph showing the return loss-frequency characteristic of the antenna according to the second embodiment of the present invention.

A description is given of an operation of the second antenna 20 having the above-described configuration. FIG. 8 is a graph showing the return loss-frequency characteristic of the second antenna 20 of this embodiment. For comparison, the return loss-frequency characteristic of the conventional discone antenna 200 (FIG. 2) of the same height and vertex angle of the conical conductor as the second antenna 20 of this embodiment is also indicated by the broken line in FIG. 8.

In the case of the conventional discone antenna 200, the return loss is less than or equal to −10 dB in a frequency band of 15.40-24.22 GHz with a frequency bandwidth of 8.82 GHz. On the other hand, according to the second antenna 20 of this embodiment, the return loss is less than or equal to −10 dB in a frequency band of 9.26-20.28 GHz with a frequency bandwidth of 11.02 GHz. Thus, compared with the conventional discone antenna 200, the second antenna 20 of this embodiment covers low frequencies, and its bandwidth is increased.

Thus, according to the second embodiment of the present invention, it is possible to make a discone antenna usable in a lower frequency band and to increase its bandwidth without complicating the structure of the discone antenna.

Third Embodiment

Figure 9:
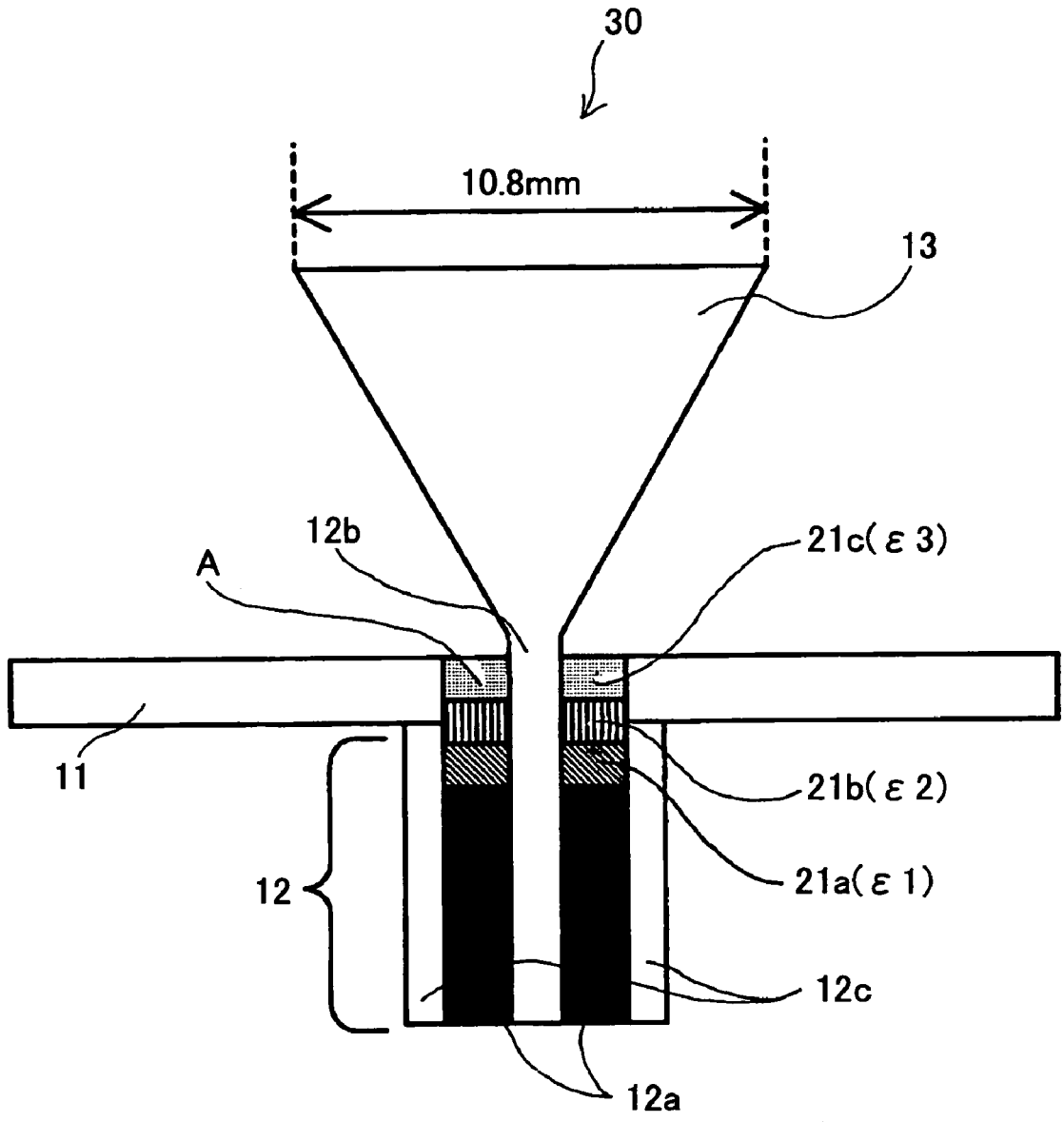
FIG. 9 is a cross-sectional view of an antenna according to a third embodiment of the present invention.

FIG. 9 is a cross-sectional view of a third antenna 30 according to a third embodiment of the present invention. In FIG. 9, the same elements as those described above are referred to by the same numerals, and a description thereof is omitted.

The third antenna 30 includes the disk conductor 11 and the first conical conductor 13. The coaxial line 12 is attached to the disk conductor 11 from its lower side. The inside of the coaxial line 12 is filled with the polyethylene 12*a* of a dielectric constant of 2.3. The center conductor 12*b* of the coaxial line 12 extends upward, being isolated from the disk conductor 11, so as to be connected to the first conical conductor 13. The coaxial line 12 further includes the outer conductor 12*c*.

In the connection end part A of the coaxial line 12 and the second antenna 20, the inside of the coaxial line 12 is filled with the polyethylene foam 21 including a polyethylene foam layer 21*a* of a dielectric constant $\epsilon$1, a polyethylene foam layer 21*b* of a dielectric constant $\epsilon$2, and a polyethylene foam layer 21*c* of a dielectric constant $\epsilon$3, serving as a member having an effective dielectric constant, so that a dielectric constant transition area is formed. The dielectric constants $\epsilon$1, $\epsilon$2, and $\epsilon$3 of the polyethylene foam layers 21*a*, 21*b*, and 21*c* are 2.0, 1.7, and 1.4, respectively. Each of the polyethylene foam layers 21*a*, 21*b*, and 21*c* is 1 mm in length in the axial directions of the coaxial line 12. The bottom surface (facing upward in FIG. 9) of the first conical conductor 13 is 10.8 mm in diameter, and the first conical conductor 13 is 9 mm in height.

Each of the disk conductor 11 and the first conical conductor 13 has a structure where a copper film is formed on the exterior surface of a dielectric, so that the weight of the third antenna 30 is reduced compared with the case of forming the whole antenna 30 of copper.

Figure 10:
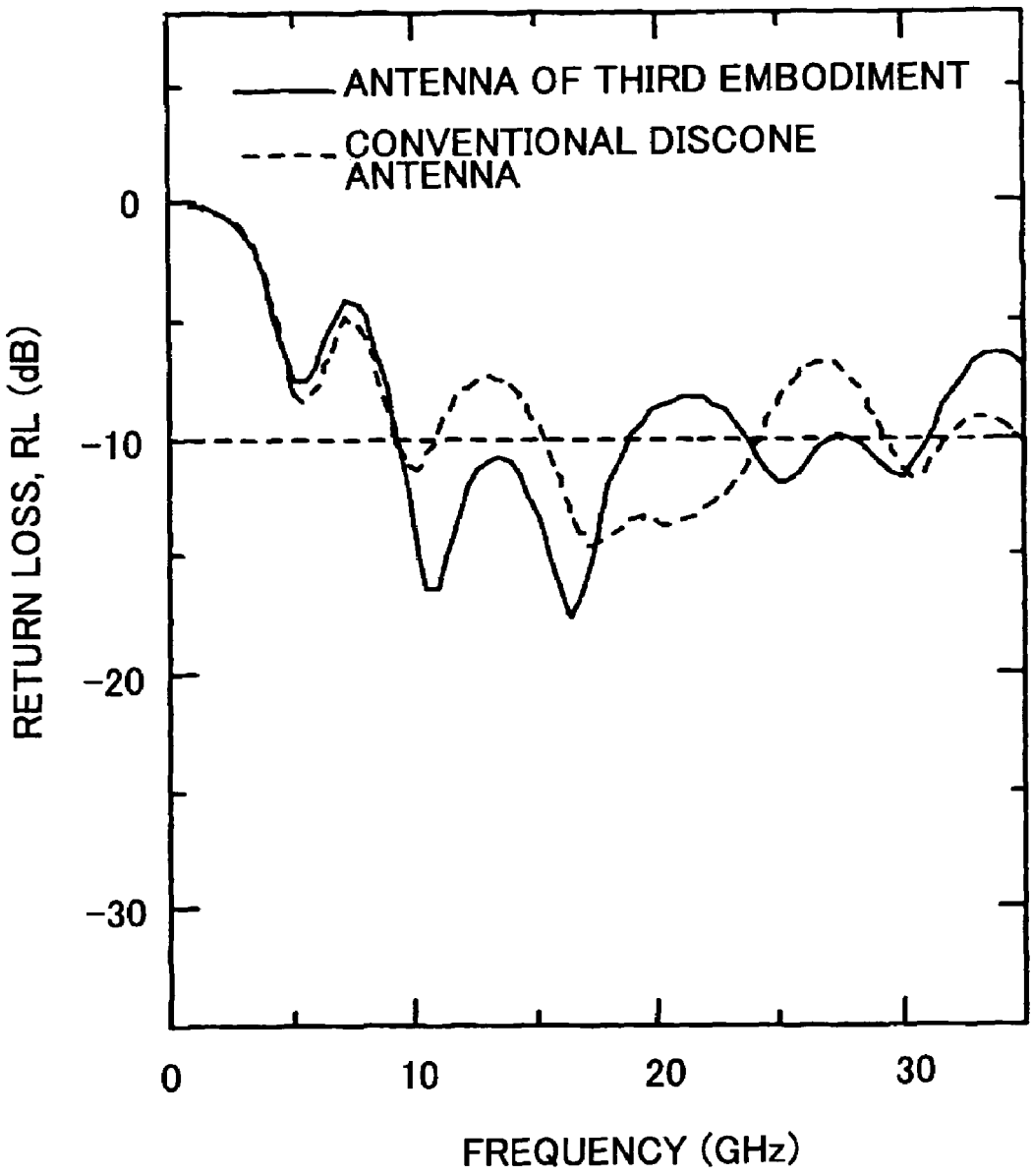
FIG. 10 is a graph showing the return loss-frequency characteristic of the antenna according to the third embodiment of the present invention.

A description is given of an operation of the third antenna 30 having the above-described configuration. FIG. 10 is a graph showing the return loss-frequency characteristic of the third antenna 30 of this embodiment. For comparison, the return loss-frequency characteristic of the conventional discone antenna 200 (FIG. 2) of the same height and vertex angle of the conical conductor as the third antenna 30 of this embodiment is also indicated by the broken line in FIG. 10.

In the case of the conventional discone antenna 200, the return loss is less than or equal to −10 dB in a frequency band of 15.40-24.22 GHz with a frequency bandwidth of 8.82 GHz. On the other hand, according to the third antenna 30 of this embodiment, the return loss is less than or equal to −10 dB in a frequency band of 9.31-18.98 GHz with a frequency bandwidth of 9.67 GHz. Thus, compared with the conventional discone antenna 200, the third antenna 30 of this embodiment covers low frequencies, and its bandwidth is increased.

Thus, according to the third embodiment of the present invention, it is possible to make a discone antenna usable in a lower frequency band and to increase its bandwidth without complicating the structure of the discone antenna. Further, it is also possible to reduce the weight of the discone antenna.

Figure 11:
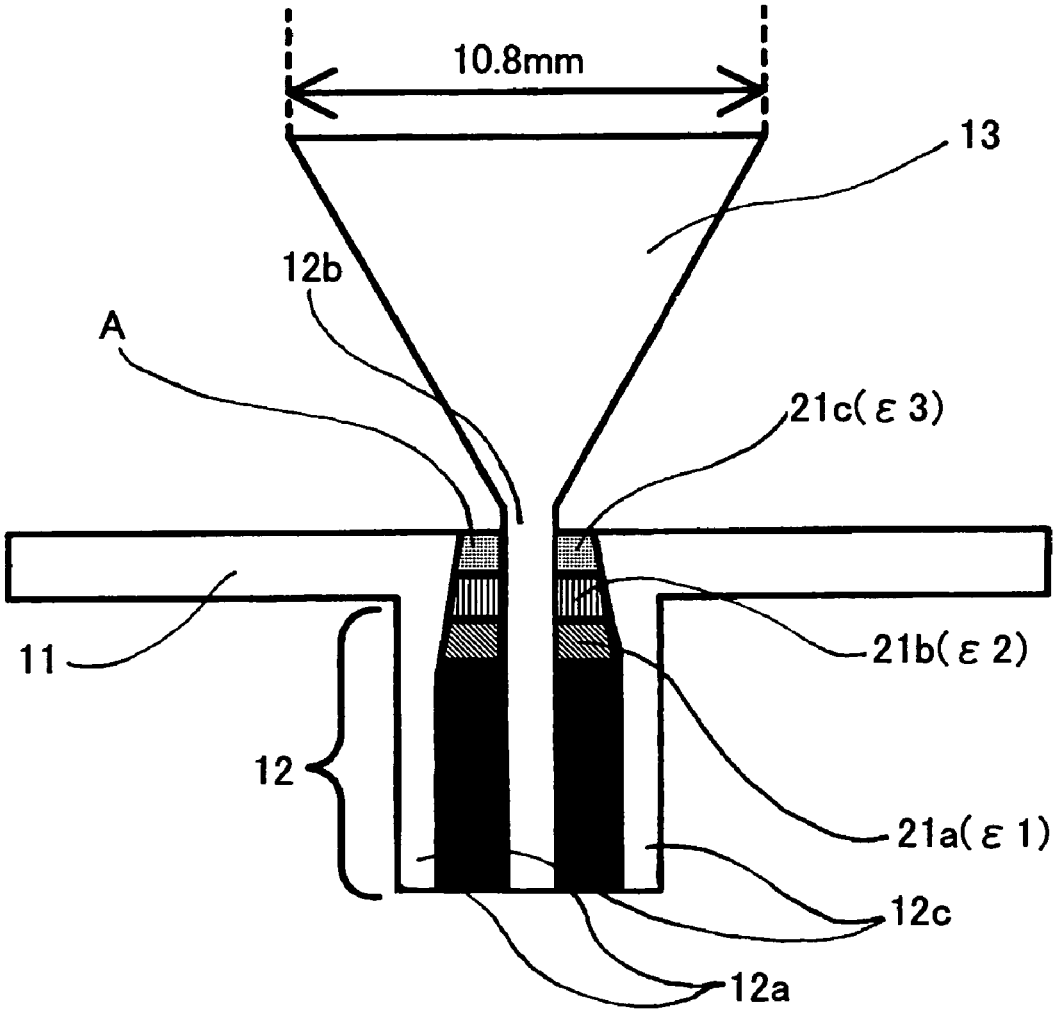
FIG. 11 is a cross-sectional view of a variation of the antenna according to the third embodiment of the present invention.

According to the third antenna 30 of this embodiment, when the dielectric constant of the polyethylene foam 21 (the polyethylene foam layers 21*a* through 21*c*) changes along the axis of the coaxial line 12, the characteristic impedance of the coaxial line 12 changes, thus resulting in increased reflection in the transition area. Therefore, as shown in FIG. 11, the inside diameter of the outer conductor 12C of the coaxial line 12 changes with changes in the dielectric constant in the transition area so that the characteristic impedance is substantially constant. Thereby, it is possible to control reflection in the transition area. The same effect can also be produced by keeping the characteristic impedance substantially constant by changing the diameter of the center conductor 12*b* (inner conductor) of the coaxial line 12.

It is possible to change the effective dielectric constant by forming the transition area of air and a dielectric member so that the ratio of volume of air to the dielectric member changes in the axial directions of the coaxial line 12. For example, the transition area may have a structure where a tapered cavity is formed in a dielectric member such as polyethylene in the axial directions of the coaxial line 12.

Fourth Embodiment

Figure 12:
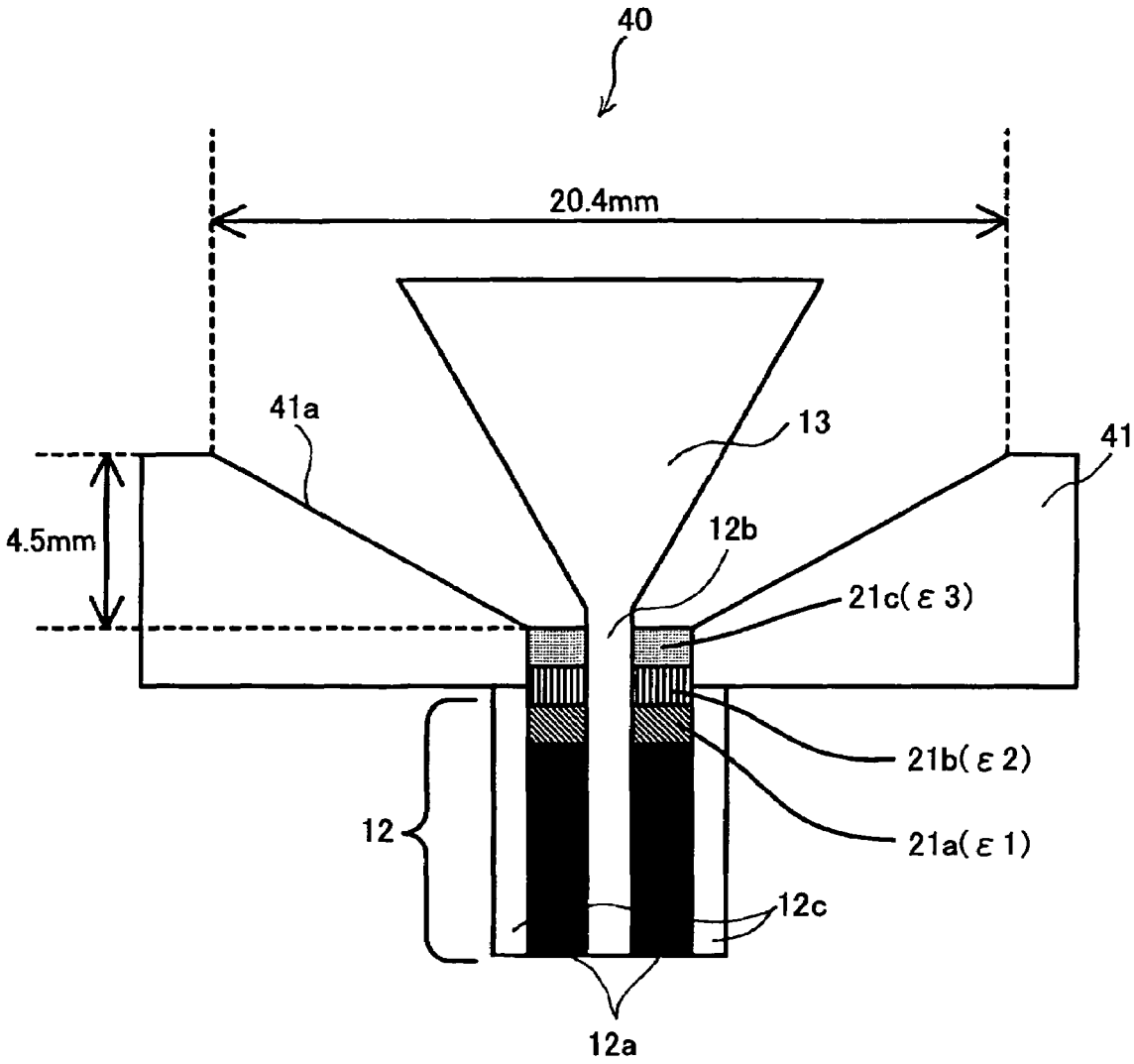
FIG. 12 is a cross-sectional view of an antenna according to a fourth embodiment of the present invention.

FIG. 12 is a cross-sectional view of a fourth antenna 40 according to a fourth embodiment of the present invention. In FIG. 12, the same elements as those described above are referred to by the same numerals, and a description thereof is omitted.

The fourth antenna 40 includes a disk conductor (conductive base plate) 41 and the first conical conductor 13. The coaxial line 12 is attached to the disk conductor 41 from its lower side. The coaxial line 12 has the polyethylene 12*a* of a dielectric constant of 2.3 filling in the space between the cylindrical outer conductor 12*c* and the center conductor 12*b*. The center conductor 12*b* of the coaxial line 12 extends upward, being isolated from the disk conductor 41, so as to be connected to the first conical conductor 13.

The disk conductor 41 has a structure formed by increasing the thickness of the disk conductor 11 and forming a conical recess 41*a* having its center at the apex of the first conical conductor 13 in the antenna 10 of the first embodiment (FIG. 5). As a result, the part of the first conical conductor 13 projecting from the disk conductor 41 is low-profile.

The conical recess 41*a* is 4.5 mm in depth, and is 20.4 mm in diameter at its edge. Each of the disk conductor 41 and the first conical conductor 13 has a structure where a copper film is formed on the exterior surface of a hollow dielectric, so that the weight of the fourth antenna 40 is reduced compared with the case of forming the whole antenna 40 of copper.

Figure 13:
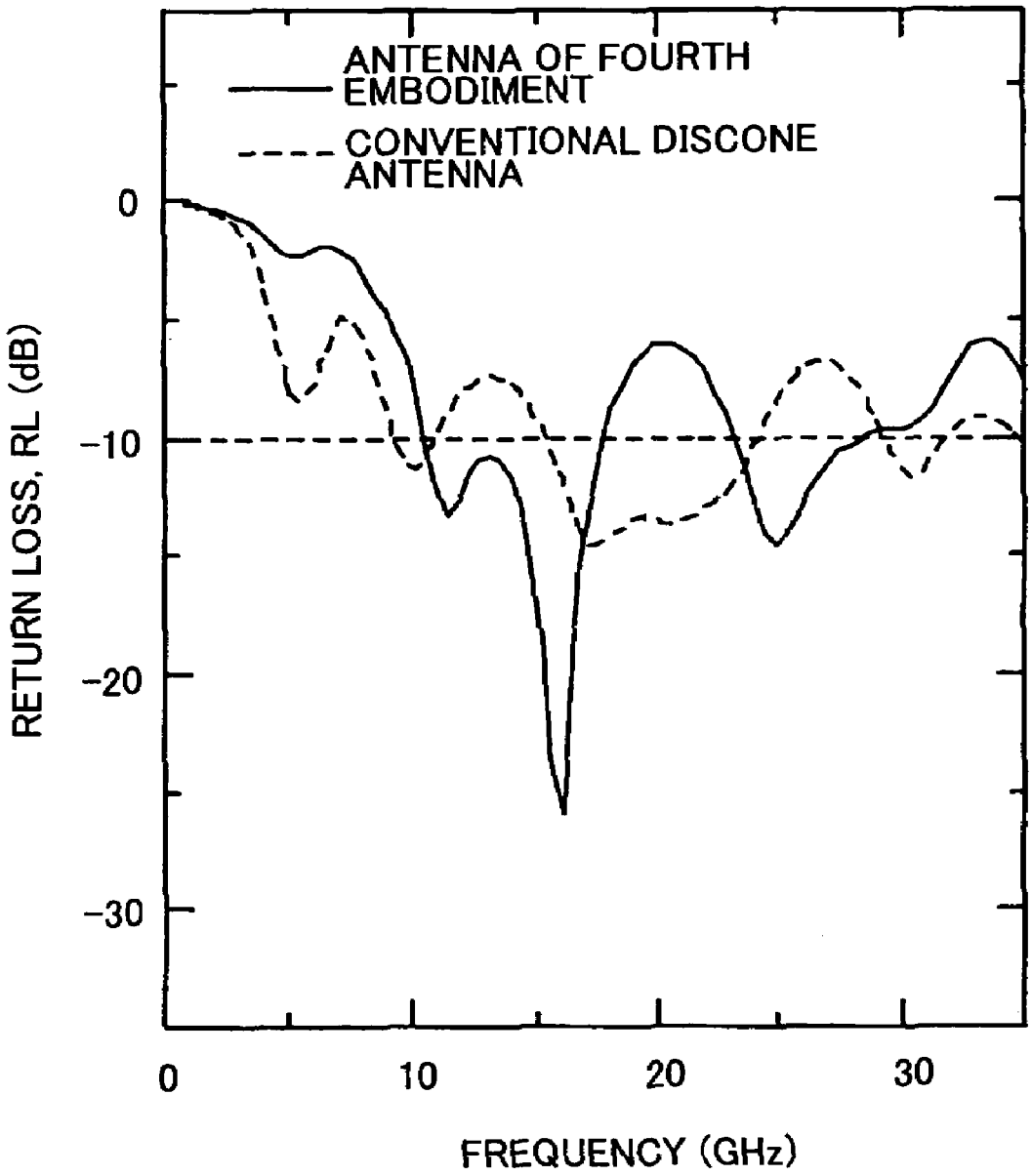
FIG. 13 is a graph showing the return loss-frequency characteristic of the antenna according to the fourth embodiment of the present invention.

A description is given of an operation of the fourth antenna 40 having the above-described configuration. FIG. 13 is a graph showing the return loss-frequency characteristic of the fourth antenna 40 of this embodiment. For comparison, the return loss-frequency characteristic of the conventional discone antenna 200 (FIG. 2) of the same height and vertex angle of the conical conductor as the fourth antenna 40 of this embodiment is also indicated by the broken line in FIG. 13.

In the case of the conventional discone antenna 200, the return loss is less than or equal to −10 dB in a frequency band of 15.40-24.22 GHz with a frequency bandwidth of 8.82 GHz. On the other hand, according to the third antenna 30 of this embodiment, the return loss is less than or equal to −10 dB in a frequency band of 10.47-17.81 GHz with a frequency bandwidth of 7.34 GHz. Thus, compared with the conventional discone antenna 200, the fourth antenna 40 of this embodiment covers low frequencies.

Thus, according to the fourth embodiment of the present invention, it is possible to make low-profile the part of a radiating element projecting from a conductive base plate and to make a discone antenna usable in a lower frequency band without complicating the structure of the discone antenna. Further, it is also possible to reduce the weight of the discone antenna.

Fifth Embodiment

Figure 14:
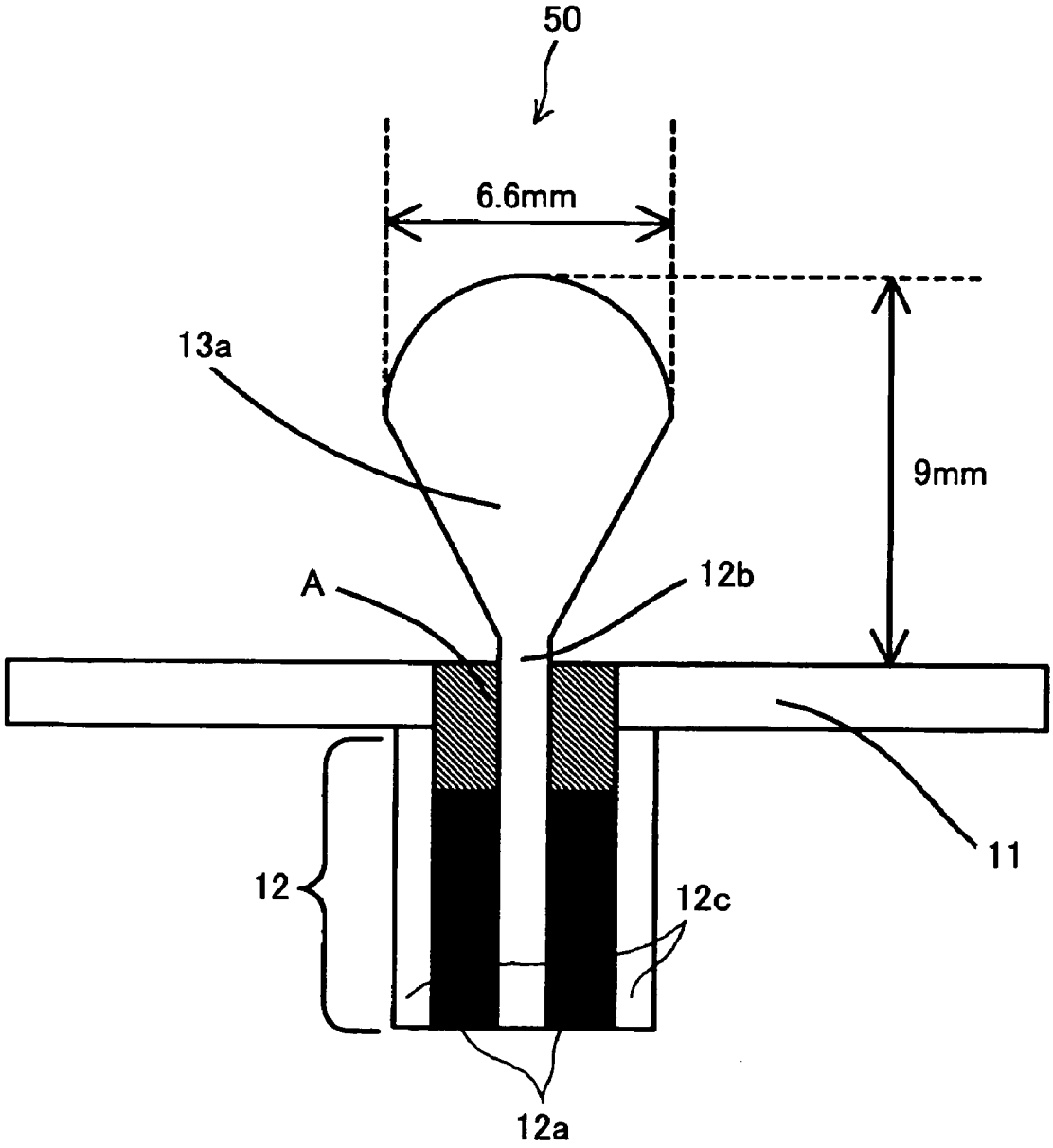
FIG. 14 is a cross-sectional view of an antenna according to a fifth embodiment of the present invention.

FIG. 14 is a cross-sectional view of a fifth antenna 50 according to a fifth embodiment of the present invention. In FIG. 14, the same elements as those described above are referred to by the same numerals, and a description thereof is omitted.

The fifth antenna 50 has the same configuration as the second antenna 20 of the second embodiment except that a second conical conductor 13*a* replaces the first conical conductor 13. The second conical conductor 13*a* has a shape where the base of a hemisphere of 6.6 mm in diameter is joined to the base of a cone. The whole radiating element is 9 mm in height.

The fifth antenna 50 of this embodiment has a reduced radiating element diameter compared with the conventional discone antenna 200 having the same height and vertex angle of the conical conductor as the fifth antenna 50. The disk conductor 11 and the second conical conductor 13*a* are formed using copper as a principal material.

Figure 15:
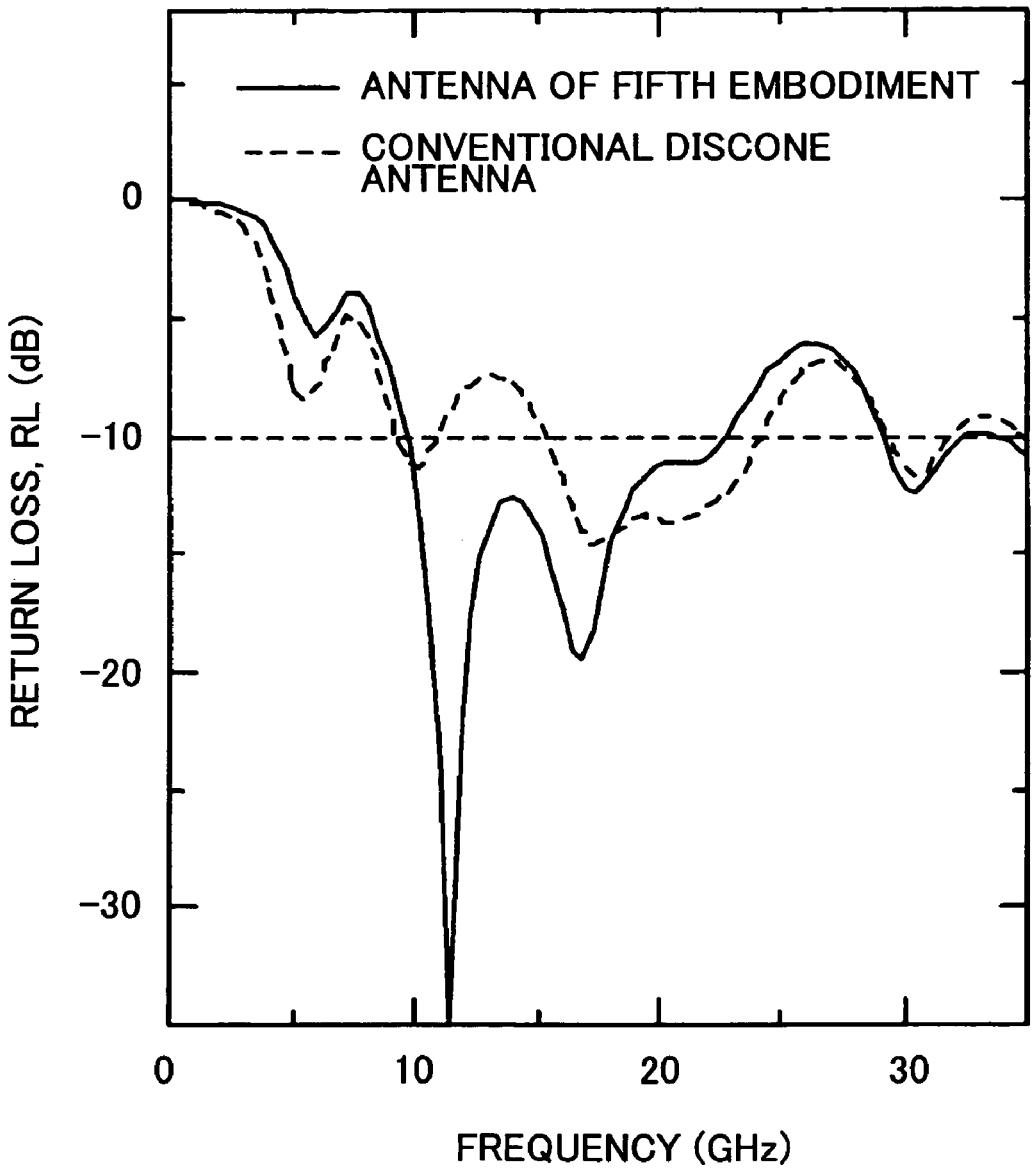
FIG. 15 is a graph showing the return loss-frequency characteristic of the antenna according to the fifth embodiment of the present invention.

A description is given of an operation of the fifth antenna 50 having the above-described configuration. FIG. 15 is a graph showing the return loss-frequency characteristic of the fifth antenna 50 of this embodiment. For comparison, the return loss-frequency characteristic of the conventional discone antenna 200 (FIG. 2) of the same height and vertex angle of the conical conductor as the fifth antenna 50 of this embodiment is also indicated by the broken line in FIG. 15.

In the case of the conventional discone antenna 200, the return loss is less than or equal to −10 dB in a frequency band of 15.40-24.22 GHz with a frequency bandwidth of 8.82 GHz. On the other hand, according to the fifth antenna 50 of this embodiment, the return loss is less than or equal to −10 dB in a frequency band of 9.62-22.77 GHz with a frequency bandwidth of 13.15 GHz. Thus, compared with the conventional discone antenna 200, the fifth antenna 50 of this embodiment covers low frequencies, and its bandwidth is increased.

Thus, according to the fifth embodiment of the present invention, it is possible to reduce the diameter of a radiating element, and to make a discone antenna usable in a lower frequency band and increase its bandwidth without complicating the structure of the discone antenna.

Sixth Embodiment

Figure 16:
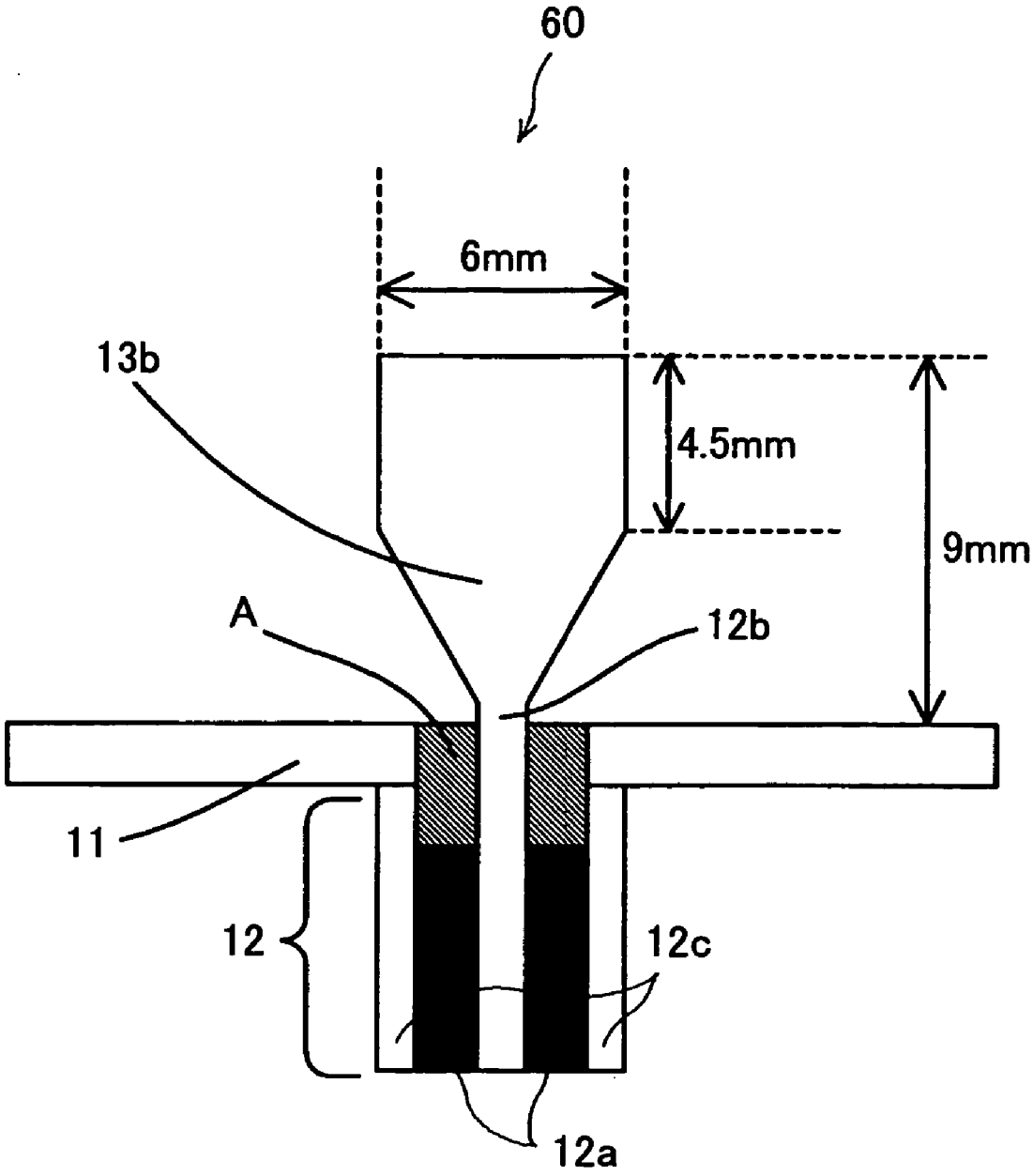
FIG. 16 is a cross-sectional view of an antenna according to a sixth embodiment of the present invention.

FIG. 16 is a cross-sectional view of a sixth antenna 60 according to a sixth embodiment of the present invention. In FIG. 16, the same elements as those described above are referred to by the same numerals, and a description thereof is omitted.

The sixth antenna 60 has the same configuration as the second antenna 20 of the second embodiment except that a third conical conductor 13*b* replaces the first conical conductor 13. The third conical conductor 13*b* has a shape where the base of a cylinder of 6.6 mm in diameter and 4.5 mm in height is joined to the base of a cone. The whole radiating element is 9 mm in height.

The sixth antenna 60 of this embodiment has a reduced radiating element diameter compared with the conventional discone antenna 200 having the same height and vertex angle of the conical conductor as the sixth antenna 60. The disk conductor 11 and the third conical conductor 13*b* are formed using copper as a principal material.

Figure 17:
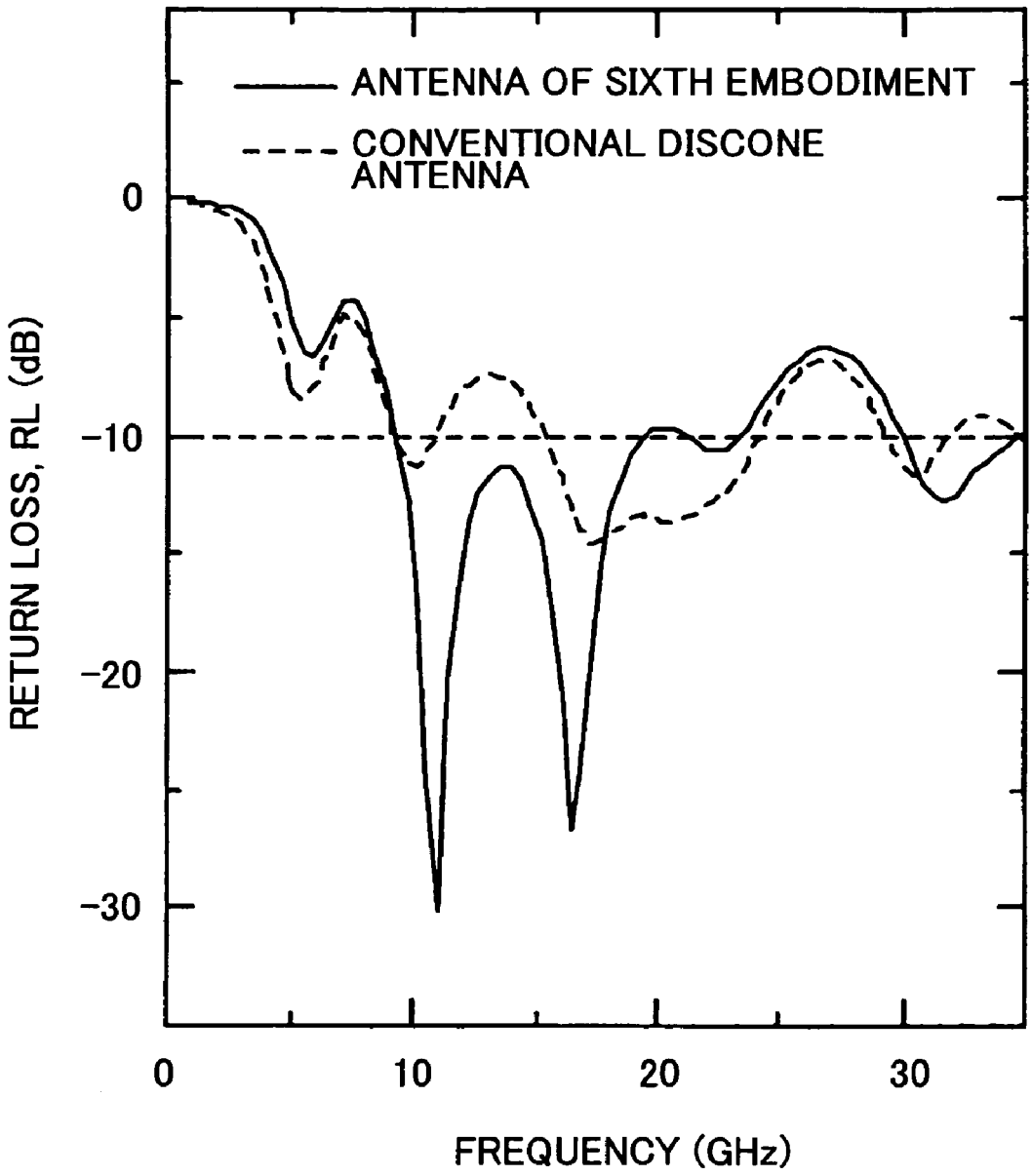
FIG. 17 is a graph showing the return loss-frequency characteristic of the antenna according to the sixth embodiment of the present invention.

A description is given of an operation of the sixth antenna 60 having the above-described configuration. FIG. 17 is a graph showing the return loss-frequency characteristic of the sixth antenna 60 of this embodiment. For comparison, the return loss-frequency characteristic of the conventional discone antenna 200 (FIG. 2) of the same height and vertex angle of the conical conductor as the sixth antenna 60 of this embodiment is also indicated by the broken line in FIG. 17.

In the case of the conventional discone antenna 200, the return loss is less than or equal to −10 dB in a frequency band of 15.40-24.22 GHz with a frequency bandwidth of 8.82 GHz. On the other hand, according to the sixth antenna 60 of this embodiment, the return loss is less than or equal to −10 dB in a frequency band of 9.27-19.57 GHz with a frequency bandwidth of 10.30 GHz. Thus, compared with the conventional discone antenna 200, the sixth antenna 60 of this embodiment covers low frequencies, and its bandwidth is increased.

Thus, according to the sixth embodiment of the present invention, it is possible to reduce the diameter of a radiating element, and to make a discone antenna usable in a lower frequency band and increase its bandwidth without complicating the structure of the discone antenna.

Seventh Embodiment

Figure 18:
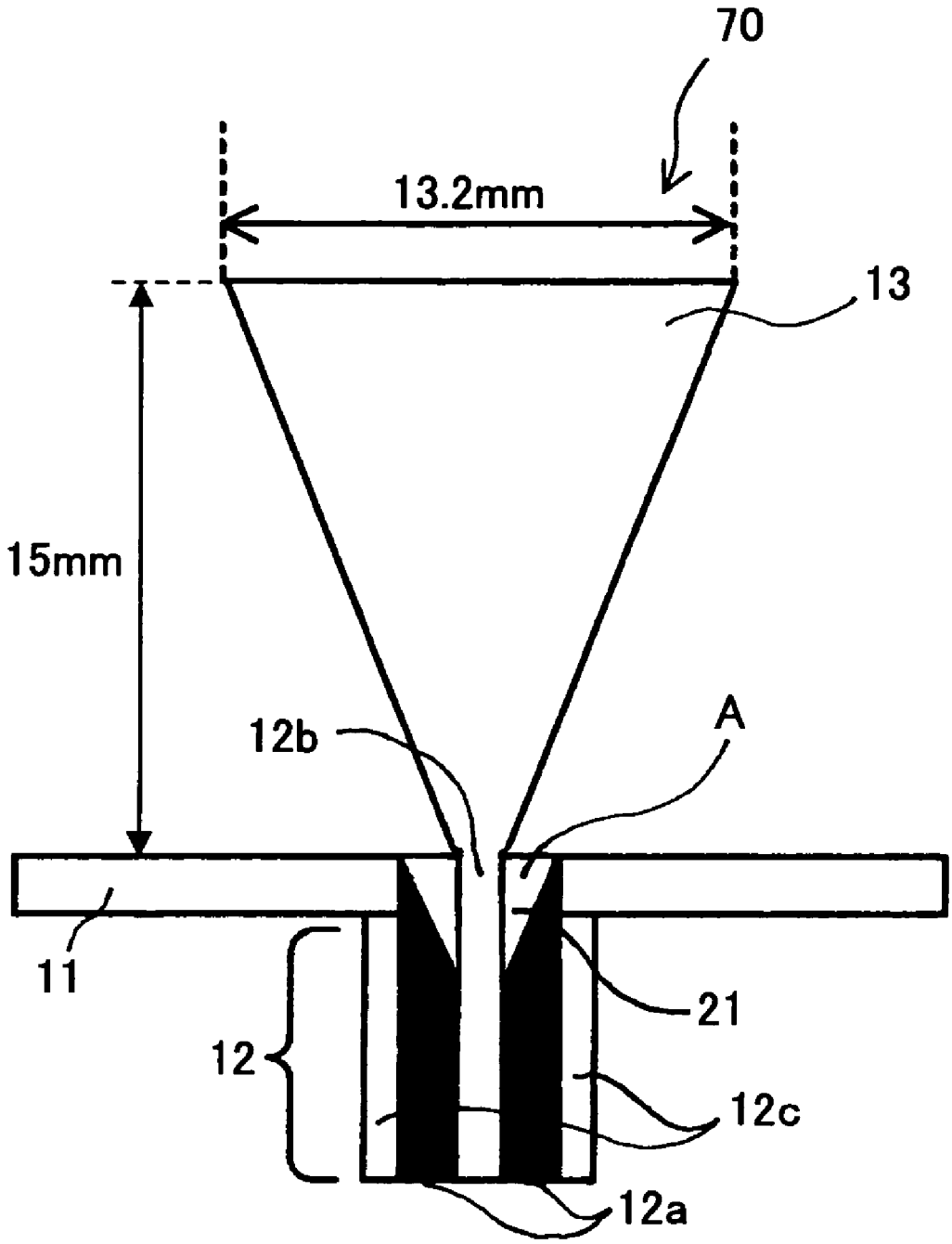
FIG. 18 is a cross-sectional view of an antenna according to a seventh embodiment of the present invention.

FIG. 18 is a cross-sectional view of a seventh antenna 70 according to a seventh embodiment of the present invention. In FIG. 18, the same elements as those described above are referred to by the same numerals, and a description thereof is omitted.

The seventh antenna 70 includes the disk conductor 11 and the first conical conductor 13. The coaxial line 12 is attached to the disk conductor 11 from its lower side. The inside of the coaxial line 12 is filled with the polyethylene 12*a* of a dielectric constant of 2.3. The center conductor 12*b* of the coaxial line 12 extends upward, being isolated from the disk conductor 11, so as to be connected to the first conical conductor 13. The coaxial line 12 further includes the outer conductor 12*c*.

In the connection end part A of the coaxial line 12 and the seventh antenna 70, the polyethylene foam 21 of a dielectric constant of 1.2 serving as an expandable dielectric material is formed like a body of revolution in the axial directions of the coaxial line 12 inside the coaxial line 12. The joining surface of the polyethylene 12*a* and the polyethylene foam 21 has a shape like the side surface of a truncated cone tapered along the axis of the coaxial line 12.

Here, the truncated cone refers to a solid employing the bottom of a right circular cone as a first bottom and a section of the right circular cone parallel to the bottom as a second bottom, where a cross-sectional shape of the solid passing through the center of the bottom and perpendicular to the bottom is a trapezoid (a quadrilateral having a pair of parallel sides). The right circular cone is a cone where the straight line connecting the apex of the cone and the center of the bottom is perpendicular to the bottom. The side surface of the truncated cone refers to the curved surface of the truncated cone which surface employs the circumferences of the first bottom and the second bottom as its sides.

In this area, the ratio of volume of the polyethylene 12*a* to the polyethylene foam 21 changes along the axis of the coaxial line 12, thereby changing the effective dielectric constant. The bottom surface (facing upward in FIG. 18) of the first conical conductor 13 is 13.2 mm in diameter, and the first conical conductor 13 is 15 mm in height. The disk conductor 11 and the first conical conductor 13 are formed using copper as a principal material.

Figure 19:
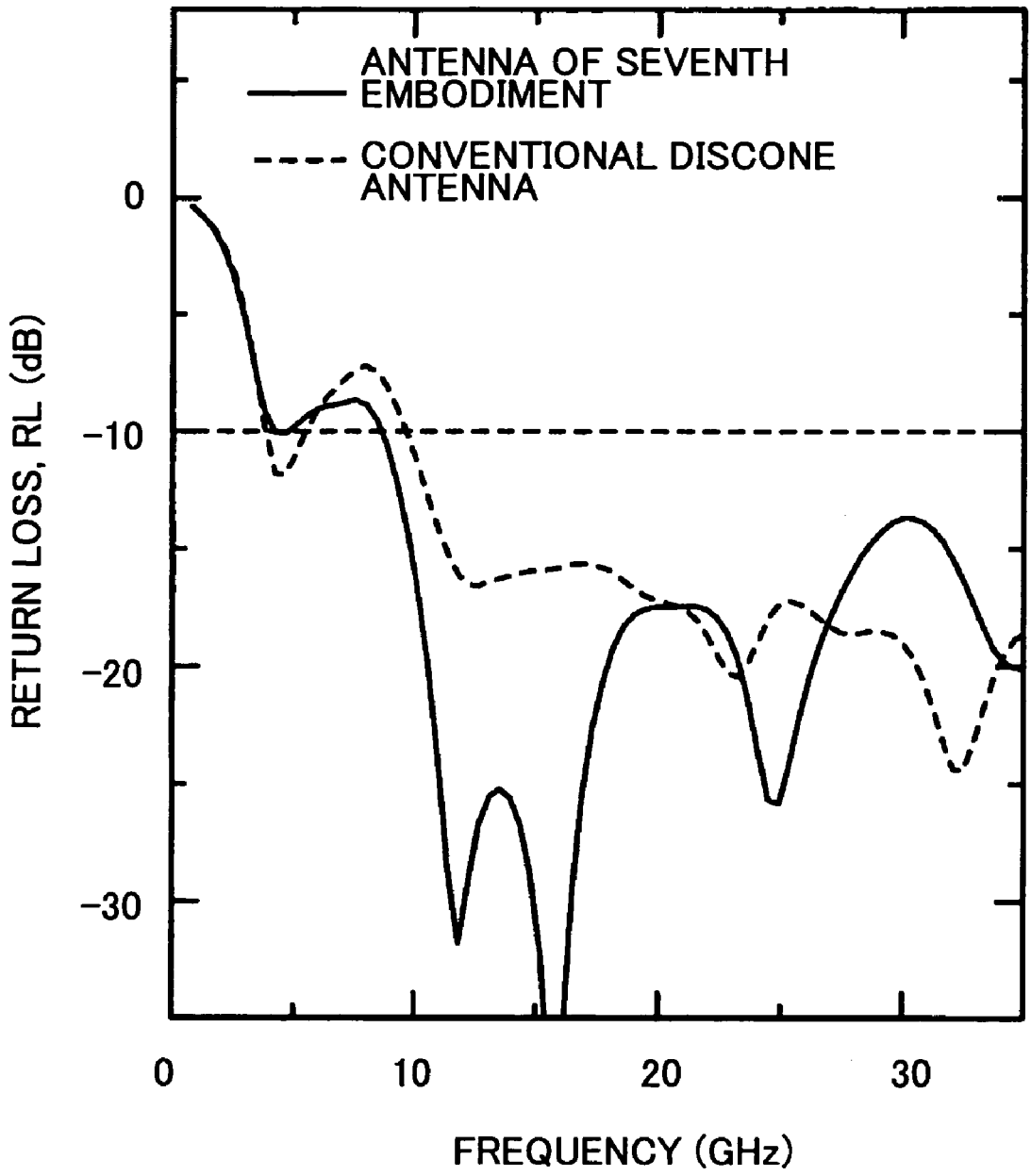
FIG. 19 is a graph showing the return loss-frequency characteristic of the antenna according to the seventh embodiment of the present invention.

A description is given of an operation of the seventh antenna 70 having the above-described configuration. FIG. 19 is a graph showing the return loss-frequency characteristic of the seventh antenna 70 of this embodiment. For comparison, the return loss-frequency characteristic of a conventional discone antenna having the same height and vertex angle of the conical conductor as the seventh antenna 70 of this embodiment is also indicated by the broken line in FIG. 19.

In the case of the conventional discone antenna, the lower limit of the frequencies at which the return loss is less than or equal to −10 dB is 9.66 GHz. On the other hand, according to the seventh antenna 70 of this embodiment, the lower limit of the frequencies at which the return loss is less than or equal to −10 dB is 8.62 GHz. Thus, compared with the conventional discone antenna, the seventh antenna 70 of this embodiment covers low frequencies.

Thus, according to the seventh embodiment of the present invention, it is possible to make a discone antenna usable in a lower frequency band without complicating the structure of the discone antenna. Further, it is also possible to produce the same effect by replacing the polyethylene foam 21 with air.

According to one aspect of the present invention, a discone antenna is provided that includes an antenna part including a conductive surface serving as a base plate (the disk conductor 11 of FIG. 5) and a conical conductor (the first conical conductor 13) having its apex opposing the conductive surface, the discone antenna being fed by a coaxial line (the coaxial line 12) including an inner conductor (the center conductor 12*b*), an outer conductor (the outer conductor 12*c*), and a dielectric (the polyethylene 12*a*) provided therebetween. The discone antenna further includes a transition area having an effective dielectric constant different from that of the dielectric in the coaxial line, the transition area being provided in the end part of the coaxial line (the connection end part A) connected to the discone antenna.

This configuration may correspond to the first through seventh embodiments of the present invention, for example, the first antenna 10 of the first embodiment shown in FIG. 5.

Figure 1:
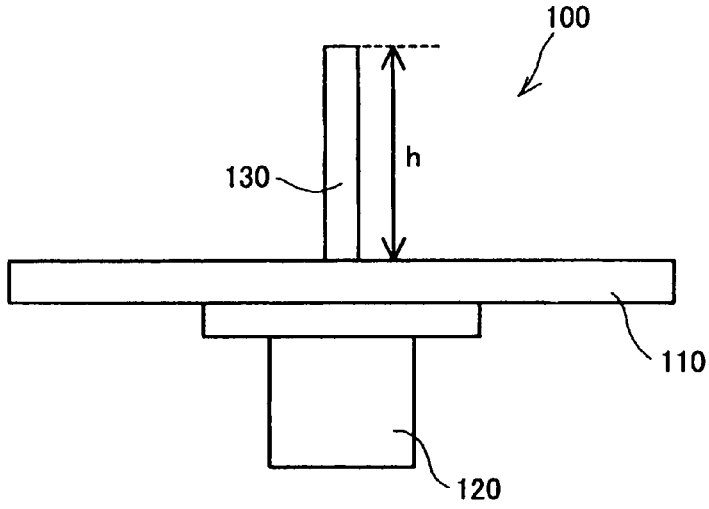
PRIOR ART FIG.1
FIG. 1 is a side view of a conventional monopole antenna.
Figure 2:
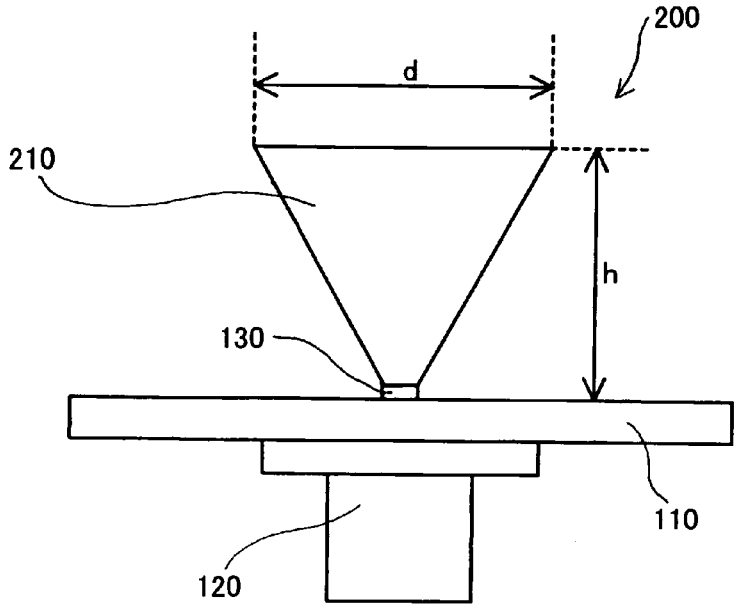
FIG. 2 is a side view of a conventional discone antenna.
Figure 3A:
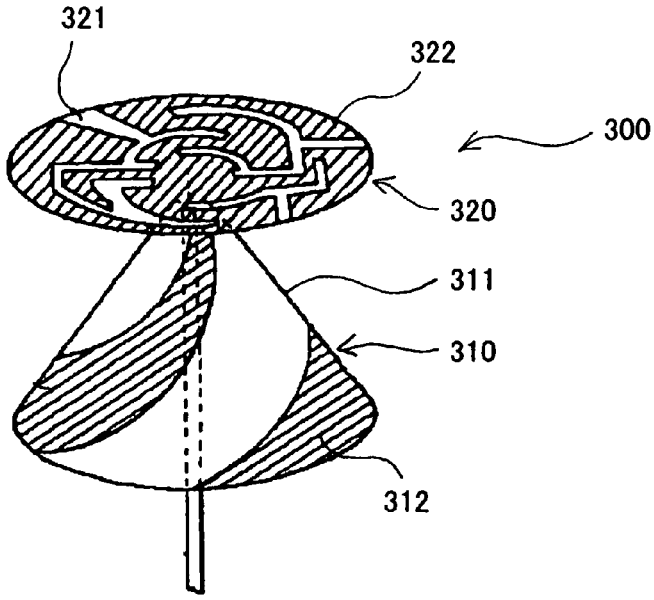
PRIOR ART FIG.3A
FIGS. 3A and 3B are a perspective view and a side view, respectively, of a first conventional antenna.
Figure 3B:
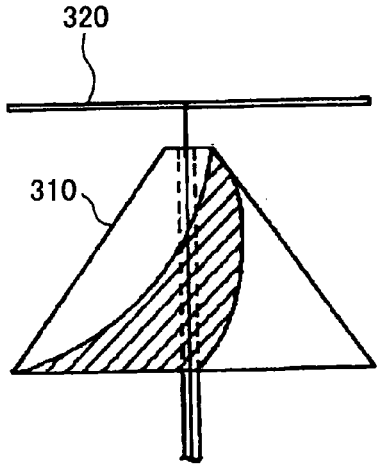
Figure 4A:
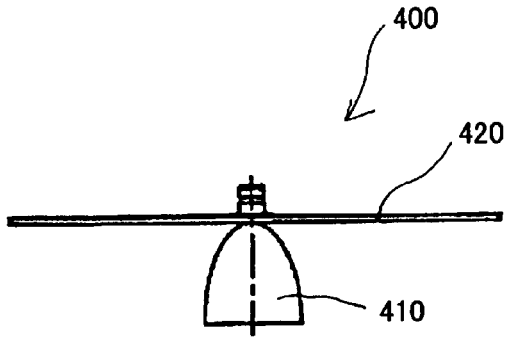
PRIOR ART FIG.4A
FIGS. 4A and 4B are a side view and a plan view, respectively, of a second conventional antenna.
Figure 4B:
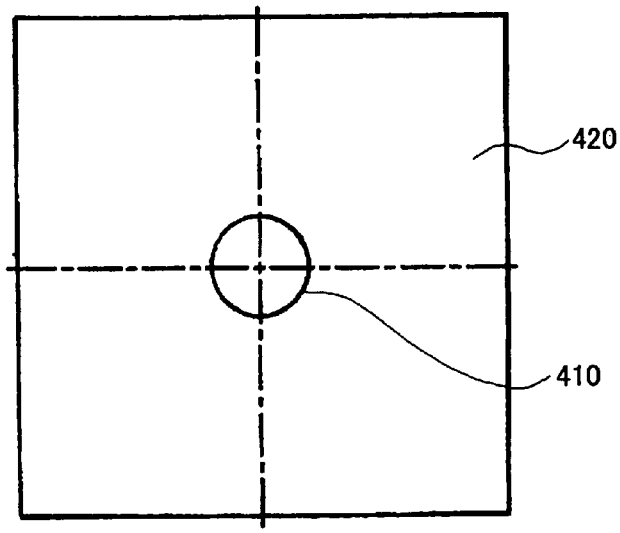

The return loss-frequency characteristic of the first antenna 10 of the first embodiment is as shown in FIG. 6. The broken line in FIG. 6 indicates the return loss-frequency characteristic of the conventional discone antenna 200 (FIG. 2).

According to this configuration, by providing a transition area having an effective dielectric constant different from that of the dielectric of a coaxial line in the end part of the coaxial line connected to a discone antenna, it is possible to control reflection due to the mismatch of the input impedance of an antenna part and the characteristic impedance of the coaxial line. Accordingly, it is possible to make the discone antenna usable in a lower frequency band and to increase its bandwidth without complicating the structure of the discone antenna.

In addition, in the discone antenna, the dielectric in the coaxial line may be removed in the transition area.

This configuration may correspond to the first embodiment (the first antenna 10) shown in FIG. 5. That is, in the connection end part A, the dielectric (the polyethylene 12*a*) is removed.

According to this configuration, by removing the dielectric in the coaxial line in the transition area so that the transition area has the dielectric constant of air, it is possible to control reflection due to the mismatch of the input impedance of the antenna part and the characteristic impedance of the coaxial line. Accordingly, it is possible to make the discone antenna usable in a lower frequency band and to increase its bandwidth without complicating the structure of the discone antenna.

In addition, in the discone antenna, the transition area may include a member (the polyethylene 21 of FIG. 7) having the effective dielectric constant between the dielectric constant of air and the dielectric constant of the dielectric in the coaxial line.

This configuration may correspond to the second through seventh embodiments, for example, the second antenna 20 of the second embodiment shown in FIG. 7. The return loss-frequency characteristic of the second antenna 20 is as shown in FIG. 8.

According to this configuration, by employing a member having the effective dielectric constant between the dielectric constant of air and the dielectric constant of the dielectric in the coaxial line, it is possible to control reflection due to the mismatch of the input impedance of the antenna part and the characteristic impedance of the coaxial line. Accordingly, it is possible to make the discone antenna usable in a lower frequency band and to increase its bandwidth without complicating the structure of the discone antenna.

In addition, in the discone antenna, the effective dielectric constant of the member having the effective dielectric constant between the dielectric constant of air and the dielectric constant of the dielectric in the coaxial line may change in the axial direction of the coaxial line.

This configuration may correspond to the third, fourth, and seventh embodiments, for example, the third antenna 30 of the third embodiment shown in FIG. 9.

The return loss-frequency characteristic of the third antenna 20 is as shown in FIG. 10.

According to this configuration, by causing the effective dielectric constant of the member having the effective dielectric constant between the dielectric constant of air and the dielectric constant of the dielectric in the coaxial line to change in the axial direction of the coaxial line (for example, the dielectric constant changes from $\epsilon 1$=2.0 to $\epsilon 2$=1.7 and to $\epsilon 3$=1.4 as shown in FIG. 9), it is possible to control reflection due to the mismatch of the input impedance of the antenna part and the characteristic impedance of the coaxial line. Accordingly, it is possible to make the discone antenna usable in a lower frequency band and to increase its bandwidth without complicating the structure of the discone antenna.

In addition, in the discone antenna, the conductive surface (the disk conductor 41 of FIG. 12) may include a conical recess (the conical recess 41*a*) having its center at the apex of the conical conductor (the first conical conductor 13).

This configuration may correspond to the fourth embodiment.

The return loss-frequency characteristic of the fourth antenna 40 of the fourth embodiment is as shown in FIG. 13.

According to this configuration, it is possible to make low-profile the part of a radiating element projecting from the conductive surface. Accordingly, it is possible to make the discone antenna usable in a lower frequency band without complicating the structure of the discone antenna.

In addition, in the discone antenna, the conical conductor may have a shape where the base of a hemisphere is joined to the base of a cone (the second conical conductor 13*a* of FIG. 14).

This configuration may correspond to the fifth embodiment.

The return loss-frequency characteristic of the fifth antenna 50 of the fifth embodiment is as shown in FIG. 15.

According to this configuration, since the conical conductor has a shape where the base of a hemisphere is joined to the base of a cone, it is possible to reduce a radiating element diameter, and to make the discone antenna usable in a lower frequency band and increase its bandwidth without complicating the structure of the discone antenna.

In addition, in the discone antenna, the conical conductor may have a shape where the base of a cylinder is joined to the base of a cone (the third conical conductor 13*b* of FIG. 16).

This configuration may correspond to the sixth embodiment.

The return loss-frequency characteristic of the sixth antenna 60 of the sixth embodiment is as shown in FIG. 17.

According to this configuration, since the conical conductor has a shape where the base of a cylinder is joined to the base of a cone, it is possible to reduce a radiating element diameter, and to make the discone antenna usable in a lower frequency band and increase its bandwidth without complicating the structure of the discone antenna.

In addition, in the discone antenna, the member having the effective dielectric constant between the dielectric constant of air and the dielectric constant of the dielectric in the coaxial line may include an expandable dielectric material (the polyethylene foam 21 of, for example, FIG. 7).

This configuration may correspond to the second through seventh embodiments, for example, the second antenna 20 of the second embodiment shown in FIG. 7.

According to this configuration, by employing an expandable dielectric material for the member forming the transition area, it is possible to obtain a dielectric material of a desired dielectric constant.

In addition, in the discone antenna, at least one of the conductive surface (the disk conductor 11 of FIG. 9) and the conical conductor (the first conical conductor 13) may have a structure where a film of conductive metal (for example, a copper film) is formed on the exterior surface of a dielectric.

This configuration may correspond to the third embodiment (the third antenna 30 shown in FIG. 9).

According to this configuration, since the conductive surface or the conical conductor has a structure where a film of conductive metal is formed on the exterior surface of a dielectric, it is possible to reduce the weight of the discone antenna.

In addition, in the discone antenna, the film of conductive metal (for example, a copper film) may be formed on the exterior surface of a hollow dielectric.

This configuration may correspond to the fourth embodiment (the fourth antenna 40 shown in FIG. 12).

According to this configuration, since the film of conductive metal is formed on the exterior surface of a hollow dielectric, it is possible to further reduce the weight of the discone antenna.

In addition, in the discone antenna, the transition area may include multiple dielectrics having different dielectric constants, and the ratio of volume of the multiple dielectrics may change in the axial direction of the axial line so that the effective dielectric constant changes.

This configuration may correspond to the seventh embodiment (the seventh antenna 70 shown in FIG. 18).

According to this configuration, the transition area includes multiple dielectrics having different dielectric constants, and the ratio of volume of the multiple dielectrics changes in the axial direction of the axial line so that the effective dielectric constant changes. Accordingly, it is possible to control reflection due to the mismatch of the input impedance of the antenna part and the characteristic impedance of the coaxial line. Accordingly, it is possible to make the discone antenna usable in a lower frequency band and to increase its bandwidth without complicating the structure of the discone antenna.

In addition, in the discone antenna, one of the multiple dielectrics forming the transition area may be air.

This configuration may correspond to the seventh embodiment where the polyethylene foam 21 is replaced by air in the seventh antenna 70 shown in FIG. 18.

According to this configuration, since the ratio of volume of multiple dielectrics changes in the axial directions of the coaxial line, it is possible to change the effective dielectric constant with ease.

In addition, in the discone antenna, each of the multiple dielectrics may be formed like a body of revolution in the axial direction of the coaxial line so that the joining surface of the multiple dielectrics has a conically tapered shape.

This configuration may correspond to the seventh embodiment.

According to this configuration, the transition area includes multiple dielectrics having different dielectric constants, and the ratio of volume of the multiple dielectrics changes in the axial direction of the axial line so that the effective dielectric constant changes. Accordingly, it is possible to control reflection due to the mismatch of the input impedance of the antenna part and the characteristic impedance of the coaxial line. Accordingly, it is possible to make the discone antenna usable in a lower frequency band and to increase its bandwidth without complicating the structure of the discone antenna.

In addition, in the discone antenna, the diameter of one of the inner conductor and the outer conductor of the coaxial line may change with a change in the effective dielectric constant in the transition area so that the characteristic impedance of the axial line is substantially constant.

This configuration may correspond to the seventh embodiment.

According to this configuration, the characteristic impedance of the coaxial line is kept substantially constant. Accordingly, it is possible to control reflection in the transition area.

The present invention is not limited to the specifically disclosed embodiments, and variations and modifications may be made without departing from the scope of the present invention.

The present application is based on Japanese Priority Patent Application No. 2005-042743, filed on Feb. 18, 2005, the entire contents of which are hereby incorporated by reference.

What is claimed is:

1. An antenna supplied with power by a coaxial line including an inner conductor, an outer conductor, and a dielectric provided between the inner conductor and the outer conductor, the antenna comprising:

an antenna part including a first conductor and a second conductor, the second conductor including a conical shape having an apex thereof opposing the first conductor; and a transition area having an effective dielectric constant different from a dielectric constant of the dielectric in the coaxial line, the transition area being provided in an end part of the coaxial line connected to the antenna.

2. The antenna as claimed in claim 1, wherein the dielectric in the coaxial line is removed in the transition area.

3. The antenna as claimed in claim 1, wherein the transition area comprises a member having the effective dielectric constant between a dielectric constant of air and the dielectric constant of the dielectric in the coaxial line.

4. The antenna as claimed in claim 3, wherein said member comprises an expandable dielectric material.

5. The antenna as claimed in claim 1, wherein:

the transition area comprises a member having the effective dielectric constant between a dielectric constant of air and the dielectric constant of the dielectric in the coaxial line; and the effective dielectric constant of the member changes in an axial direction of the coaxial line.

6. The antenna as claimed in claim 5, wherein said member comprises an expandable dielectric material.

7. The antenna as claimed in claim 5, wherein:

the transition area comprises a plurality of dielectrics having different dielectric constants; and a ratio of volume of said plural dielectrics changes in the axial direction of the axial line so that the effective dielectric constant changes.

8. The antenna as claimed in claim 7, wherein said plural dielectrics comprise air.

9. The antenna as claimed in claim 7, wherein each of said plural dielectrics is formed like a body of revolution in the axial direction of the coaxial line so that a joining surface of said plural dielectrics has a conically tapered shape.

10. The antenna as claimed in claim 1, wherein the first conductor comprises a conical recess having a center thereof at the apex of the second conductor.

11. The antenna as claimed in claim 1, wherein the second conductor is shaped like a cone.

12. The antenna as claimed in claim 1, wherein the second conductor has a shape where a base of a hemisphere is joined to a base of a cone.

13. The antenna as claimed in claim 1, wherein the second conductor has a shape where a base of a cylinder is joined to a base of a cone.

14. The antenna as claimed in claim 1, wherein at least one of the first conductor and the second conductor has a structure where a film of conductive metal is formed on an exterior surface of a dielectric.

15. The antenna as claimed in claim 1, wherein:

at least one of the first conductor and the second conductor has a structure where a film of conductive metal is formed on an exterior surface of a hollow dielectric.

16. The antenna as claimed in claim 1, wherein a diameter of one of the inner conductor and the outer conductor of the coaxial line changes with a change in the effective dielectric constant in the transition area so that characteristic impedance of the axial line is substantially constant.

17. The antenna as claimed in claim 1, wherein the antenna is a discone antenna.

* * * * *